US011060381B2

(12) United States Patent
Thiemann et al.

(10) Patent No.: US 11,060,381 B2
(45) Date of Patent: Jul. 13, 2021

(54) TONG CASSETTE POSITIONING DEVICE

(71) Applicant: Weatherford Technology Holdings, LLC, Houston, TX (US)

(72) Inventors: Bjoern Thiemann, Burgwedel (DE); Ernst Fuehring, Lindhorst (DE)

(73) Assignee: WEATHERFORD TECHNOLOGY HOLDINGS LLC, Houston, TX (US)

( * ) Notice: Subject to any disclaimer, the term of this patent is extended or adjusted under 35 U.S.C. 154(b) by 242 days.

(21) Appl. No.: 16/109,222

(22) Filed: Aug. 22, 2018

(65) Prior Publication Data

US 2020/0063529 A1 Feb. 27, 2020

(51) Int. Cl.

| | |
|---|---|
| ***E21B 41/00*** | (2006.01) |
| ***E21B 19/16*** | (2006.01) |
| ***E21B 47/00*** | (2012.01) |

(52) U.S. Cl.

CPC ..... *E21B 41/00* (2013.01); *E21B 19/161* (2013.01); *E21B 47/00* (2013.01)

(58) Field of Classification Search

CPC ..... E21B 19/16; E21B 19/161; E21B 19/165; E21B 41/00; E21B 47/00

See application file for complete search history.

(56) References Cited

U.S. PATENT DOCUMENTS

| | | | | |
|---|---|---|---|---|
| 6,142,041 | A | 11/2000 | Buck | |
| 7,001,065 | B2 | 2/2006 | Dishaw et al. | |
| 7,178,612 | B2 * | 2/2007 | Belik | E21B 19/00 175/162 |
| 7,841,415 | B2 * | 11/2010 | Winter | E21B 19/16 166/382 |
| 7,878,254 | B2 | 2/2011 | Abdollahi et al. | |
| 7,958,787 | B2 | 6/2011 | Hunter | |
| 9,068,406 | B2 | 6/2015 | Clasen et al. | |
| 2002/0074125 | A1 | 6/2002 | Fikes et al. | |
| 2004/0223533 | A1 * | 11/2004 | Dishaw | G01J 5/0022 374/4 |
| 2008/0282847 | A1 | 11/2008 | Halse | |
| 2008/0307930 | A1 | 12/2008 | Veverica et al. | |
| 2009/0065189 | A1 * | 3/2009 | Hobgood | E21B 19/165 166/77.51 |
| 2009/0159294 | A1 | 6/2009 | Abdollahi et al. | |
| 2011/0120730 | A1 * | 5/2011 | Clasen | E21B 19/165 166/381 |
| 2013/0168516 | A1 | 7/2013 | Winter | |

(Continued)

OTHER PUBLICATIONS

Amezaga, et al.: Optical Imaging and Assessment System for Tong Cassette Positioning Device; U.S. Appl. No. 15/681,141, filed Aug. 18, 2017. (Not Attached.).

(Continued)

*Primary Examiner* — Christopher J Sebesta

(74) *Attorney, Agent, or Firm* — Patterson + Sheridan, LLP

(57) ABSTRACT

A method for connecting a tong cassette and a positioning device includes moving a positioning arm of the positioning device toward a predetermined position on the rig; identifying a position of the tong cassette relative to the positioning arm; and connecting the positioning arm to the tong cassette. A system includes a tong cassette; and a positioning device having a first sensor configured to measure a distance between the tong cassette and the positioning device; and a second sensor configured to measure a stick-up height of a tubular string.

23 Claims, 9 Drawing Sheets

(56) References Cited

U.S. PATENT DOCUMENTS

| | | | | |
|---|---|---|---|---|
| 2013/0271576 | A1* | 10/2013 | Ellis | G06F 30/20 348/46 |
| 2013/0319674 | A1* | 12/2013 | Boudreaux | E21B 31/12 166/297 |
| 2014/0233804 | A1 | 8/2014 | Gustavsson et al. | |

OTHER PUBLICATIONS

PCT International Search Report and Written Opinion dated Nov. 26, 2019, for International Application No. PCT/US2019/047315.

* cited by examiner

TONG CASSETTE POSITIONING DEVICE

BACKGROUND

Field

Embodiments of the present disclosure generally relate to automated connections between a positioning device and tong cassettes for oil and gas rig equipment.

Description of the Related Art

In an oil and gas rig environment, multiple operations may be performed simultaneously or in a fast sequence, wherein multiple connections may need to be made between tools on an oil and gas rig. For example, mechanical and utility connections may be used to move a tool around the rig floor and provide power, data, hydraulic, pneumatic, and other utilities to the tool. When multiple connections are used to operate a tool, there is an increased probability of malfunction of any one of the connections leading to malfunction of the tool. Also, the change over time from one tool to another creates costs that may also be problematic in conjunction with the downtime caused to the customer.

Sometimes making connections between tools on a rig may expose rig personnel to hazardous areas. During operations such as rig-up or rig-down of equipment, rig personnel may be exposed to safety risks. However, such operations may be necessary to completely remove or install equipment on the rig. These operations are commonly time consuming and risky to rig personnel. For example, for tong cassette rig-up, the tong cassette is brought to the rig floor using a rig crane. If the tong cassette is inside a tray, it is lifted out of the tray and manually installed on the positioning device using a tugger line. Rig personnel then align the tong cassette. Once the tong cassette is hanging from the positioning device, locking pins are placed and power lines are connected for tong cassette operations. The tugger line is disconnected from tool, and the empty tray is removed from the rig floor. The reverse process is performed to rig-down the tong cassette from the positioning device. These processes involve considerable intervention of rig personnel performing many different operations or steps requiring high level of attention and expertise.

During drilling and casing running operations, make-up and/or break-out of pipe connections may be required. This may be accomplished by using an iron roughneck or tong with a back-up that is positioned in the well center by a positioning device. The same positioning device is commonly used for drilling and running casing—only the tool installed in the positioning device is interchanged depending on the operation to be performed. Changing operations requires removing the tong cassette to run the subsequent operation. This activity is time consuming and can introduce rig personnel to safety hazards. Due to the size and the weight of the tong and wellbore tools, the tong on a positioning device may swing or tilt during tool transfer or tool operation.

After all the utility connections have been made between the cassette and the positioning device, the tong cassette is ready for operation.

There is a need for new and improved methods and apparatus for aligning a positioning device and tong cassette to enable automated connections between the positioning device and tong cassette on an oil and gas rig.

SUMMARY

The present disclosure generally relates to automated tool exchange of tong cassettes for a positioning device.

One embodiment of the present disclosure is a method for connecting a tong cassette and a positioning device includes moving a positioning arm of the positioning device toward a predetermined position on the rig; identifying a position of the tong cassette relative to the positioning arm; and connecting the positioning arm to the tong cassette.

Another embodiment of the present disclosure is a system including a tong cassette; and a positioning device having a first sensor configured to measure a distance between the tong cassette and the positioning device; and a second sensor configured to measure a stick-up height of a tubular string.

Another embodiment of the present disclosure is a method for connecting a tong cassette and a connector frame of a positioning device, includes: placing the tong cassette at a predetermined position on the rig; moving a connector frame of the positioning device toward the predetermined position; identifying a position of the tong cassette relative to the connector frame; and connecting the tong cassette to the connector frame.

Another embodiment of the present disclosure is a non-transitory computer readable medium including instructions, that when executed by one or more processors, executes a method for connecting a tong cassette and a connector frame of a positioning device, the method including: placing the tong cassette at a predetermined position on the rig; moving a connector frame of the positioning device toward the predetermined position; identifying a position of the tong cassette relative to the connector frame; and connecting the tong cassette to the connector frame.

Another embodiment of the present disclosure is a non-transitory computer readable medium including instructions, that when executed by one or more processors, executes a method for connecting a tong cassette and a connector frame of a positioning device, the method including: moving a positioning arm of the positioning device toward a predetermined location on the rig, determining a position of the tong cassette relative to the positioning arm, and connecting the positioning arm to the tong cassette.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIG. 2A illustrates equipment, including a positioning device and a tong cassette, of the exemplary sensor system. FIG. 2B illustrates a sensor located on a positioning device. FIG. 2C illustrates another sensor located on another positioning device. FIG. 2D illustrates a tong cassette. FIG. 2E illustrates another interaction between the positioning device and the tong cassette.

DETAILED DESCRIPTION

In one embodiment, a sensor system is installed on a positioning device to determine a positional relationship between the positioning device and a tong cassette. The sensor system may be beneficial for a variety of different purposes.

In one embodiment, the sensor system is used for automated tong cassette connection and disconnection. In order to reduce rig personnel exposure and reduce rig-up and rig-down times, the sensor system can be installed on the positioning device to automate this process. A tong cassette can be placed on the rig floor at a predetermined location. Once the tong cassette has been placed on the rig floor, an operator selects the predetermined location in a control system of the positioning device. The control system sends commands to the positioning device based on the operator's selection. The commands instruct the positioning device to begin extending arms holding a connector frame towards the predetermined location. As the connector frame approaches the predetermined location, the sensor system operates to detect a positional relationship between the connector frame and the tong cassette. For example, the sensor system detects a proximity of the connector frame to the tong cassette. The sensor system also detects an orientation of the connector frame to the tong cassette. The sensor system may relay information about the positional relationship to the control system for analysis. The control system in conjunction with the sensor system sends commands to move the positioning device and connector frame thereon into a position where the tong cassette can be mechanically and operationally connected to the connector frame.

Figure 1:
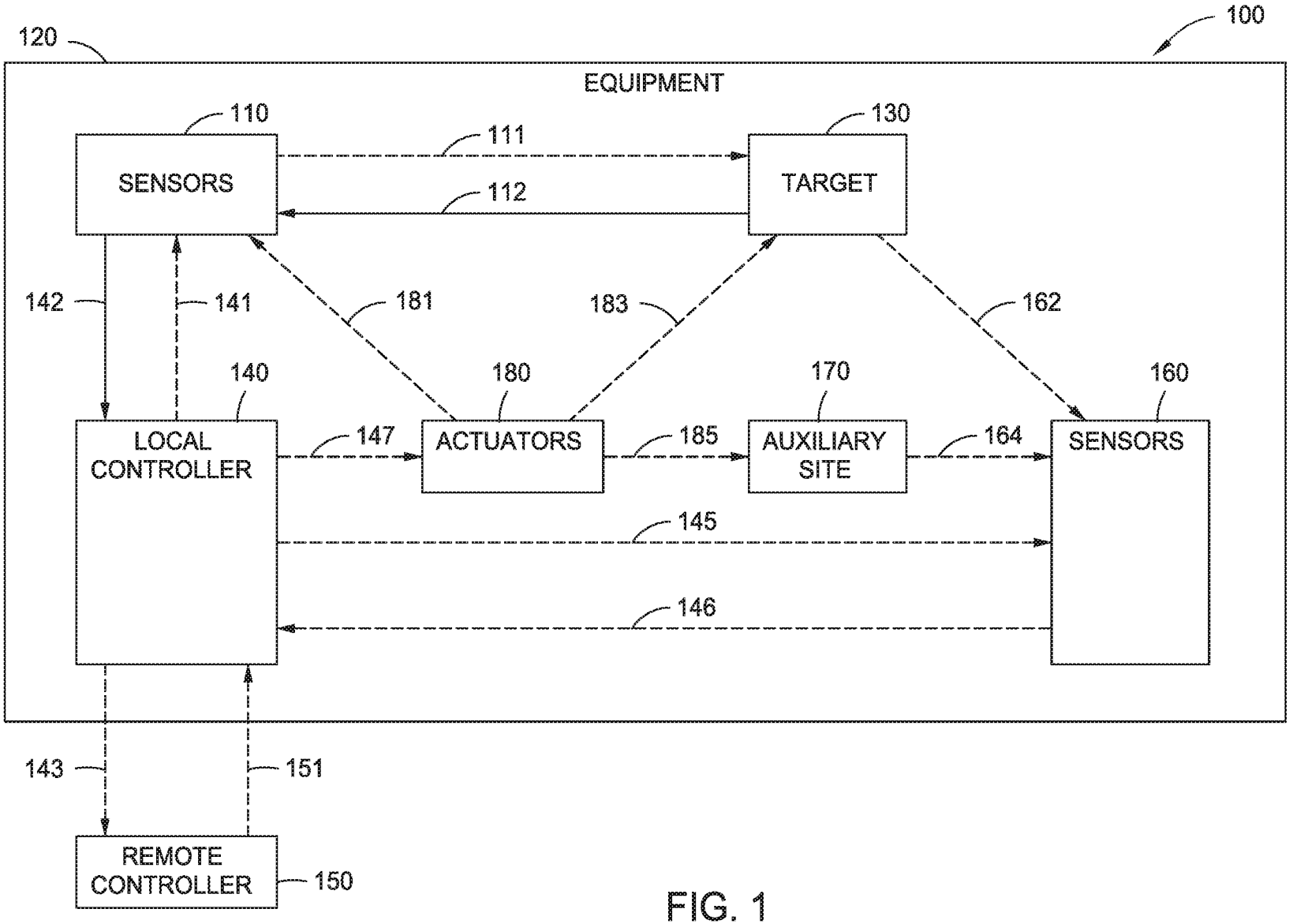
FIG. 1 illustrates an exemplary sensor system.

An exemplary sensor system 100 is illustrated in FIG. 1. In the illustrated embodiment, one or more sensors 110 are located on equipment 120 (e.g., a positioning device and/or tong cassette) on a rig. Exemplary sensors include proximity sensors and length transducers. A proximity sensor may detect the presence of nearby objects or targets without any physical contact. The proximity sensor may emit an electromagnetic field or a beam of electromagnetic radiation and detect changes in the field or a return signal. The target may be a metal target. Another exemplary sensor 110 is an optical imaging device such as cameras, 3D cameras, high speed cameras, time lapse cameras, infrared cameras, light detector, charged-coupled device, wide-angled lens camera, high resolution camera, time-of-flight camera, stop motion camera, motion picture camera, stereoscopic camera, and combinations thereof. The optical imaging device is located on the equipment 120 to capture optical images of objects or targets, including humans or objects in the path of the equipment. The sensors 110 are positioned to be able to detect measurements 112 about a target 130 on equipment 120. In some embodiments, the sensor 110 may include a micro controller. The micro controller may be capable of performing data analysis based on signals detected by the sensor 110.

A local controller 140 is also located on the equipment 120. The local controller 140 is functionally connected to the sensor 110. For example, in some embodiments, the local controller 140 may be able to send commands 141 to the sensor 110, and the sensor 110 may be able to receive commands 141. As another example, the local controller 140 may be able to receive information 142 from the sensor 110, and the sensor 110 may be able to send information 142. For example, the information 142 may be a signal in response to detection of the target 130 by the sensor 110. The information 142 may be, for example, distance to pipe, height of pipe (e.g., stick-up height), width of pipe, relative distance between tong cassette and positioning device, etc. In some embodiments, the local controller 140 may be able to store, analyze, and/or retransmit the information 142 received from the sensor 110.

In some embodiments, the local controller 140 may be able to send data 143 to a remote controller 150, and remote controller 150 may be able to receive data 143. For example, the local controller 140 may be able to retransmit the information 142 as data 143. In some embodiments, the local controller 140 may analyze and/or process the information 142, and the local controller 140 may send the results as data 143. The data 143 may be, for example, feedbacks, distance to pipe, height of pipe, width of pipe, status of jaws, status of backup, position of pipe, relative distance between tong cassette and positioning device, etc. The remote controller 150 may be located at a remote location from the equipment 120. For example, the remote controller 150 may be located in a control room of the rig, or the remote controller may be at a location that is remote from the rig. The remote controller 150 may receive data 143 from the local controller 140 and/or other inputs (e.g., operator input, scheduling input, input from other systems on the rig, etc.). The remote controller may analyze and/or process the data 143 and/or other inputs. The remote controller may be able to send control commands 151 to local controller 140, and local controller 140 may be able to receive commands 151. Data, inputs, commands and/or signals may be sent between local controller 140 and remote controller 150 over a variety of communication channels, including, for example, wires, fiber optics, hydraulic lines, pneumatic lines, and/or wirelessly, including electromagnetic or acoustic signaling.

In some embodiments, local controller 140 may be functionally connected with other sensors 160 on equipment 120. The other sensors 160 are differentiated from the one or more sensors 110. In some embodiments, the other sensors 160 acquire measurements 162 about target 130 that is supplemental to the measurements 112. In some embodiments, the other sensors 160 acquire measurements 164 about one or more auxiliary sites 170 on equipment 120. In some embodiments, the local controller 140 may be able to send commands 145 to the other sensors 160, and the other sensors 160 may be able to receive commands 145. In some embodiments, the local controller 140 may be able to receive information 146 from the other sensors 160, and the other sensors 160 may be able to send information 146. In some embodiments, the local controller 140 may be able to store, analyze, and/or retransmit the information 146 received from the other sensors 160. For example, the local controller 140 may analyze information 142 from sensor 110 in combination with information 146 from other sensors 160.

In some embodiments, local controller 140 may be functionally connected with actuators 180 on equipment 120. For example, in some embodiments, the local controller 140 may be able to send commands 147 (e.g., control signals) to the actuators 180, and the actuators 180 may be able to receive commands 147. The commands 147 may be based on, or in response to, the information 142, information 146, and/or analysis of information 142/146. In some embodiments, the commands 147 may instruct the actuators 180 to cause action 181 (e.g., positioning and/or orienting) at the equipment 120. In some embodiments, the commands 147 may instruct the actuators 180 to cause action 183 at the target 130. In some embodiments, the commands 147 may instruct the actuators 180 to cause action 185 at the auxiliary site 170.

In one embodiment, a sensor 110 is located on equipment 120 (e.g., a tong cassette). The sensor 110 is positioned to be able to detect a target 130 on equipment 120. A local controller 140 is also located on the equipment 120 adjacent to the sensor 110. The local controller 140 is functionally connected to the sensor 110. In some embodiments, information from sensor 110 may include the relative position and orientation between the equipment 120 and other equipment, such as a positioning device.

Another exemplary sensor system 400 is illustrated in FIGS. 2A-2E. In the embodiment illustrated in FIG. 2A, equipment 420 includes a positioning device 420-*p*, a tong cassette 420-*t*, and rig floor 420-*r*. Positioning device 420-*p* and a tong cassette 420-*t* may be located on a demarked rig floor 420-*r*. In some embodiments, positioning device 420-*p* is secured to the rig floor 420-*r*. In some embodiments, positioning device 420-*p* may be secured such that positioning device 420-*p* may rotate and/or move vertically relative to rig floor 420-*r*. Positioning device 420-*p* may be configured to lift and/or move tong cassette 420-*t* from one position and/or orientation on or near the rig floor 420-*r* to another position and/or orientation. In one embodiment, the positioning device 420-P includes a pair of extending arms 420-*a* for engaging the tong cassette 420-*t*. A variety of positioning devices are currently available, many suitable for adapting to embodiments disclosed herein. For example, a suitable positioning device 420-*p* is disclosed in U.S. Pat. No. 9,068,406. Another suitable positioning device 420-*p* is disclosed in co-pending U.S. patent application Ser. No. 15/667,504. In some embodiments, the initial state of sensor system 400 includes data representative of tong cassette 420-*t* being generally located on rig floor 420-*r* within demarcation 425-*t*, and of positioning device 420-*p* being generally located on rig floor 420-*r* within demarcation 425-*p*, but exact positioning/orientation of each remains unquantified. Such initial state data may be stored, for example, in remote controller 450. In some embodiments, the tong cassette 420-*t* is located within demarcation 425-*t* in an initial state. In some embodiments, the demarcation 425-*t* is a predetermined location on the rig floor 420-*r*. In some embodiments, the predetermined location on the rig floor 420-*r* is stored, for example, in the remote controller 450.

Figure 2A:
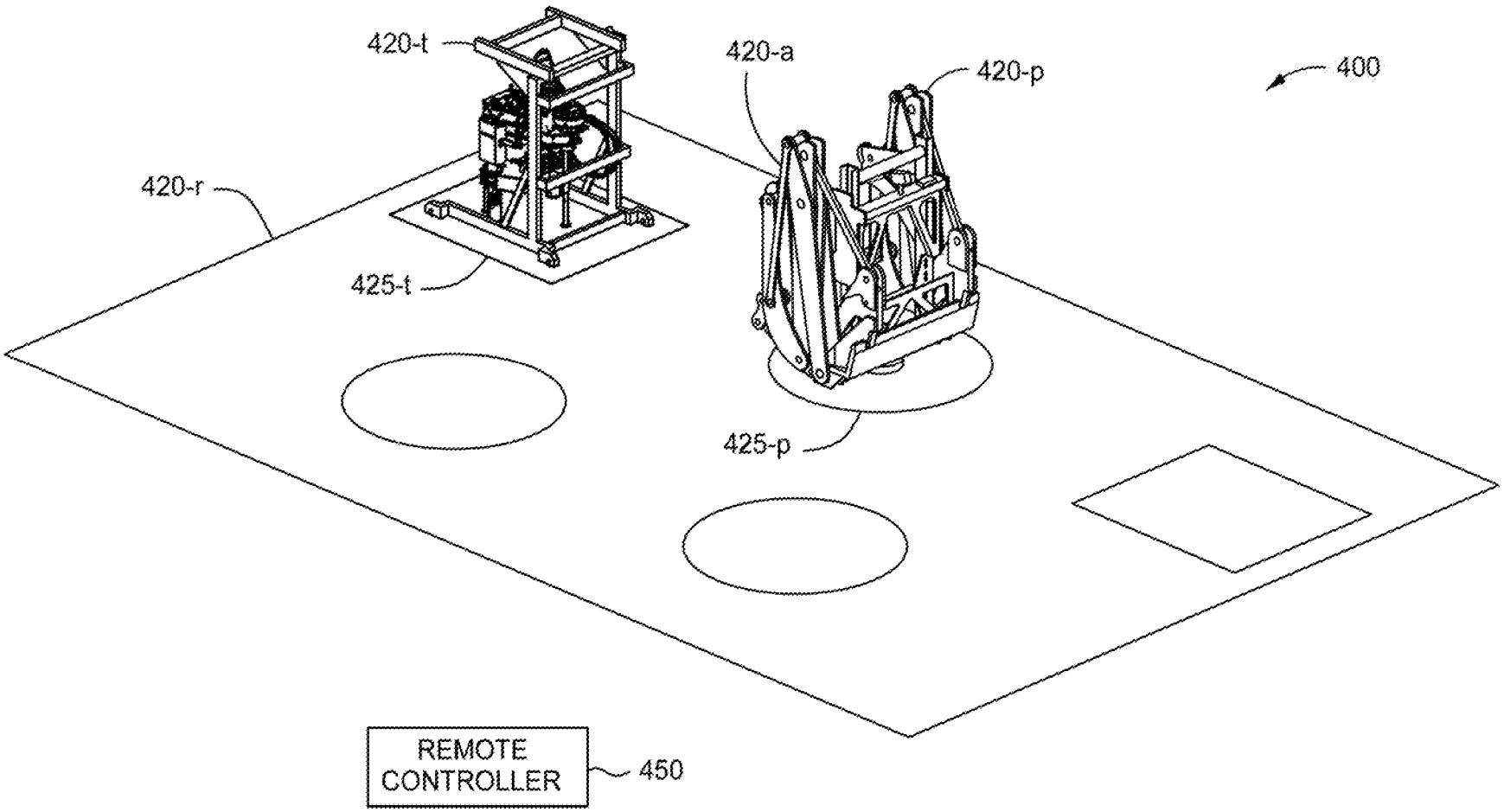
FIGS. 2A-2E illustrate another exemplary sensor system.
Figure 2B:
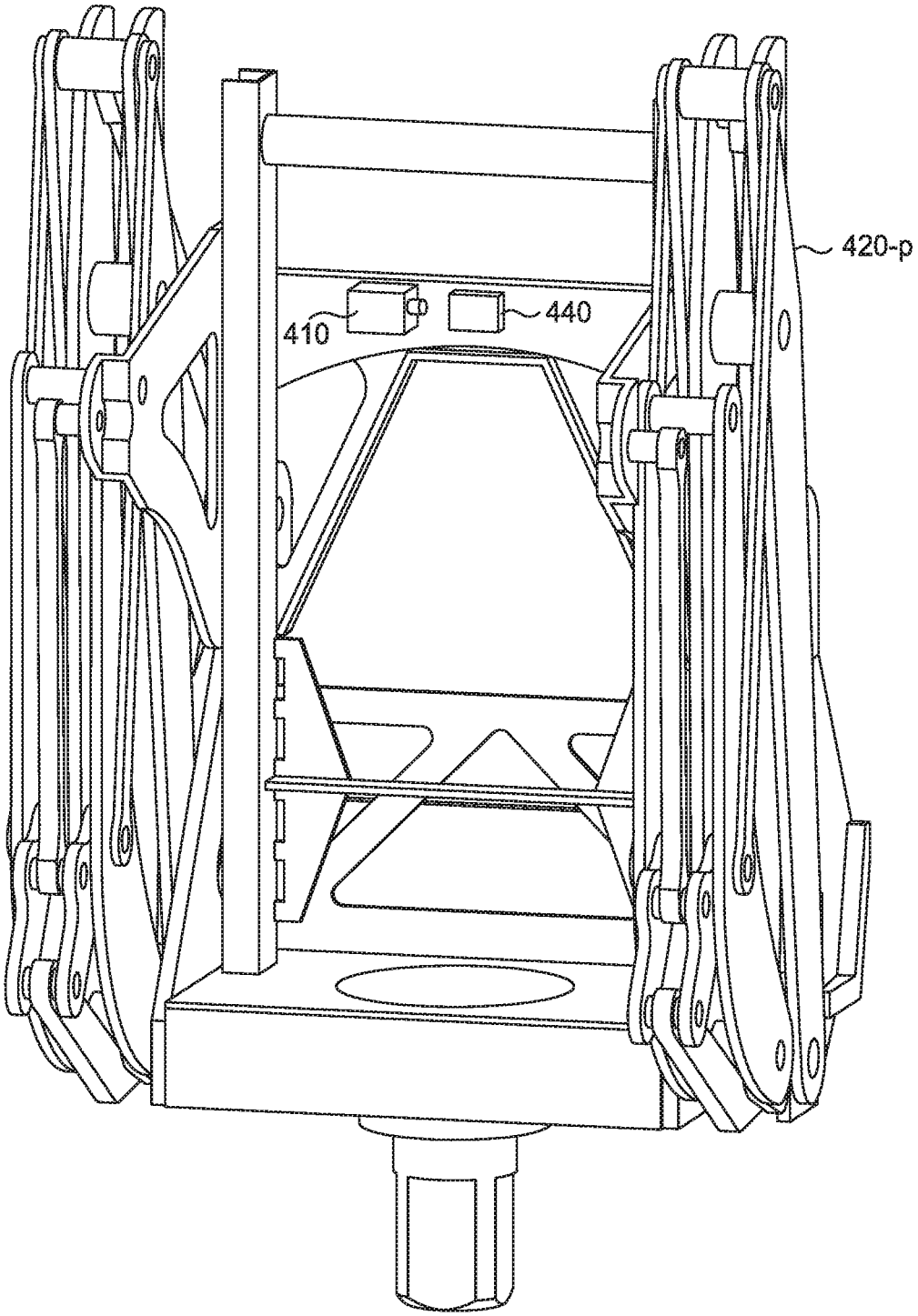

As illustrated in FIG. 2B, a sensor 410 (e.g., length transducer, proximity sensor, etc.) is located on the positioning device 420-*p*. The sensor 410 is positioned to be able to detect a target located on another piece of equipment, such as the tong cassette 420-*t* or the tubular string located at well center. The sensor 410 is functionally connected to local controller 440. Local controller 440 may be able to send data to and/or receive commands from remote controller 450.

Figure 2C:
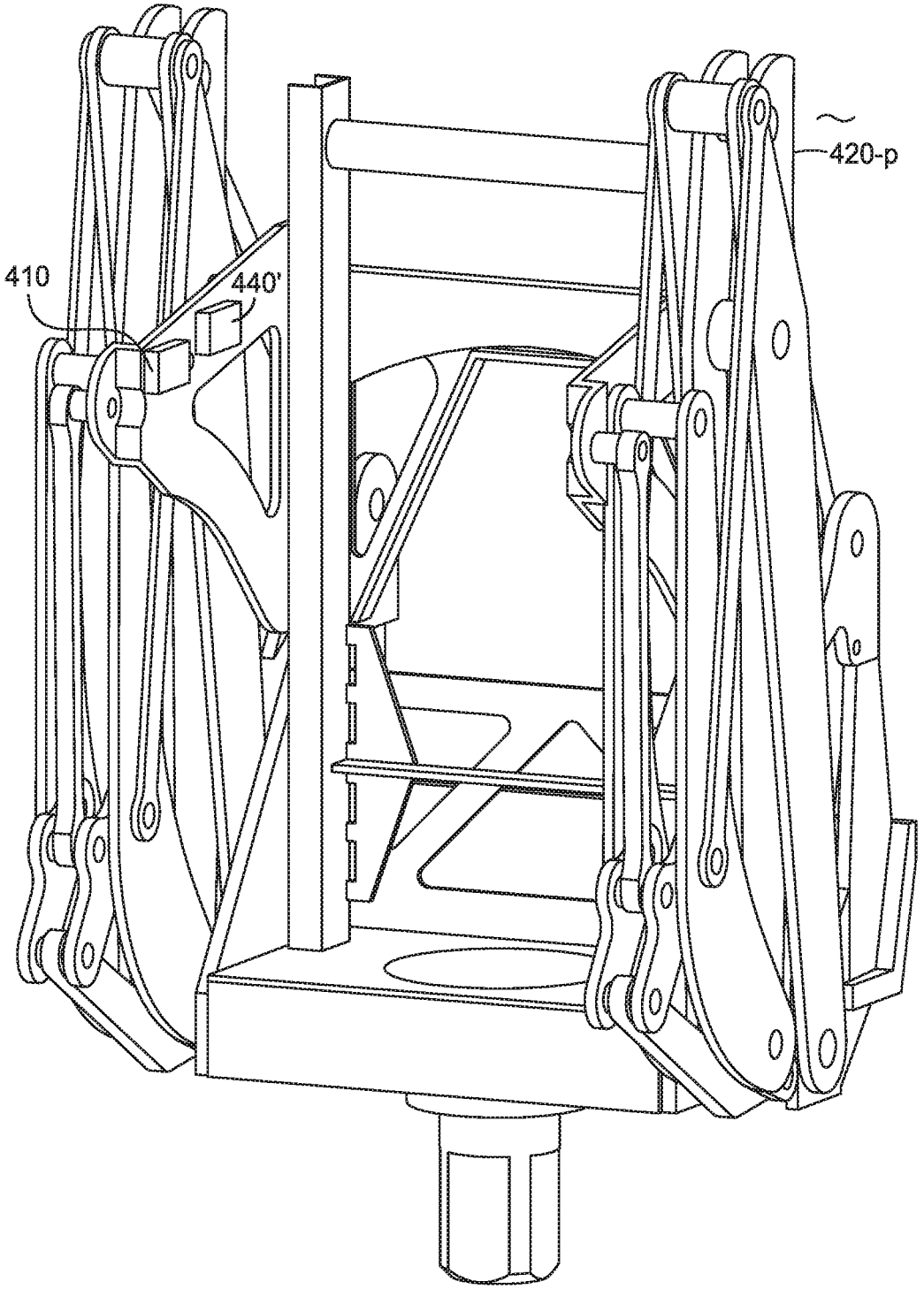

Alternatively, as illustrated in FIG. 2C, a sensor 410' is located at a different location on the positioning device 420-*p*. The sensor 410' is positioned to be able to detect a target on another piece of equipment, such as the tong cassette 420-*t* or a tubular string located at well center. The sensor 410' is functionally connected to local controller 440'. Local controller 440' may be able to send data to and/or receive commands from remote controller 450. The location of sensor 410' on the positioning device 420-*p* may be changed according to operational and/or manufacturing specifications. For example, when the desired location of target is changed, the location of sensor 410' may be changed.

Figure 2D:
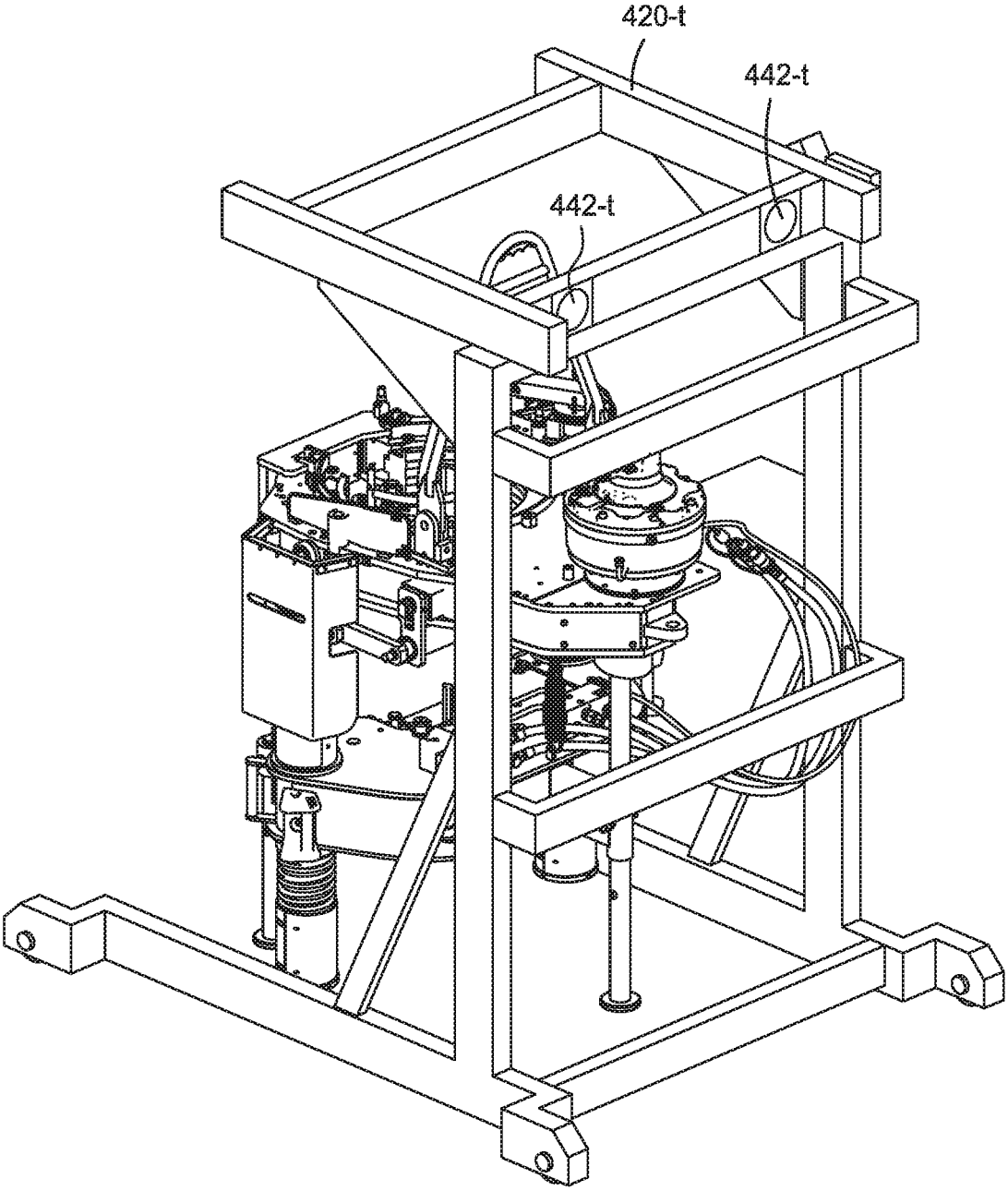

An exemplary tong cassette 420-*t* is illustrated in FIG. 2D. One or more targets 4424 is located on tong cassette 420-*t*. In some embodiments, one or more of the targets 442-*t* is oriented towards the sensor. The location of target(s) 442-*t* on tong cassette 420-*t* may be changed according to operational and/or manufacturing specifications. For example, when the desired location of sensor 410 is changed, the location of target(s) 442-*t* may be changed. In some embodiments, the targets 442-*t* may be located symmetrically on tong cassette 420-*t*.

Figure 2E:
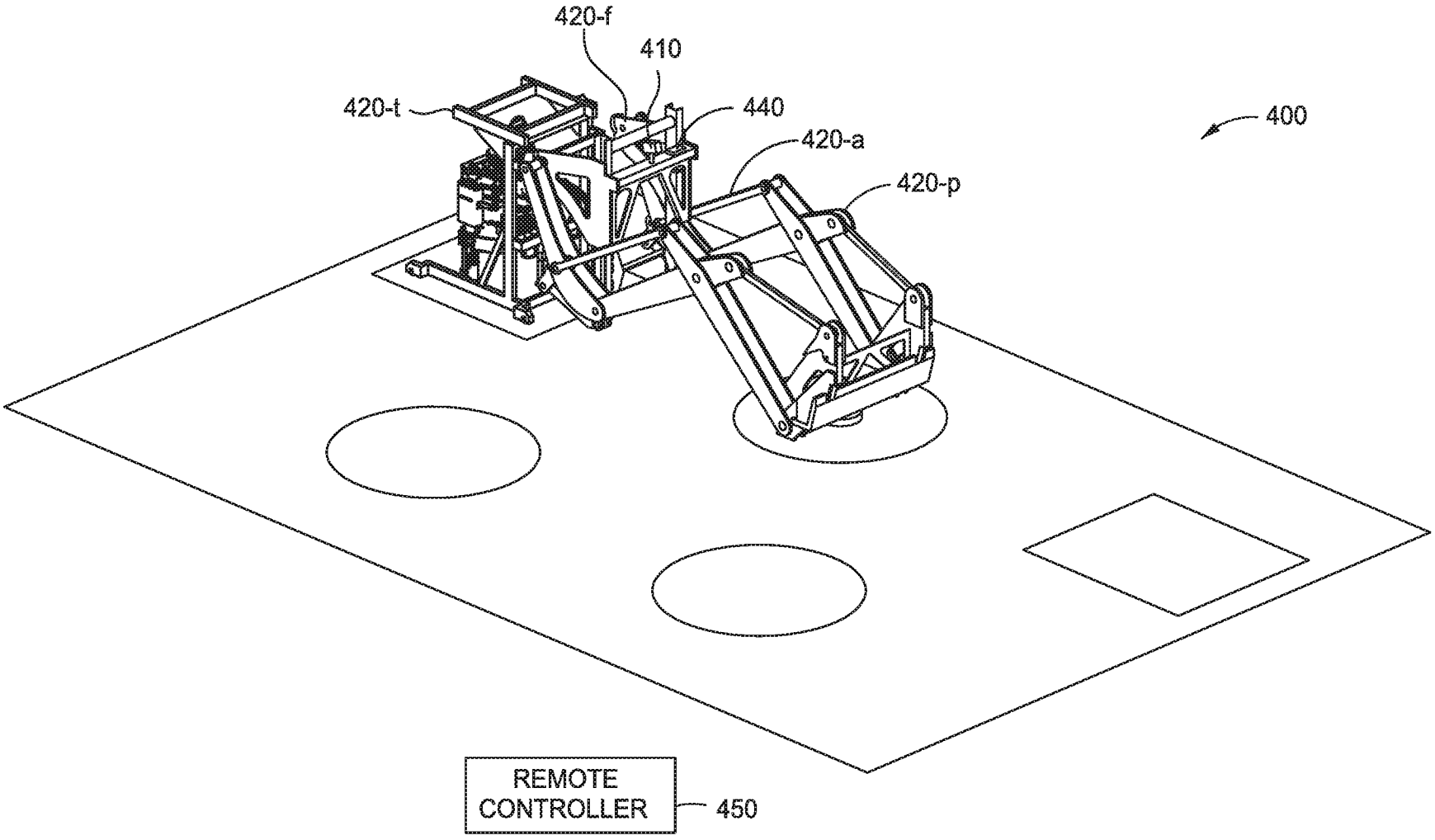

As illustrated in FIG. 2E, during operation, the tong cassette 420-*t* may be oriented towards the positioning device 420-*p*. In some embodiments, the one or more targets 442-*t* may be detectable by the sensor 410 on the positioning device 420-*p*. The sensor 410 may detect one or more targets 442-*t* of tong cassette 420-*t*. The local controller 440 may be able to receive information 442 from the sensor 410. For example, the information 442 includes location information of the one or more targets 442-*t*, distance between the one or more targets 442-*t*, size of the one or more targets 442-*t*, relative orientation of the one or more targets 442-*t*, distance between positioning device 420-*p* and tong cassette 420-*t*, and/or orientation angle between positioning device 420-*p* and tong cassette 420-*t*. In addition to information of the targets 442-*t* of the tong cassette 420-*t*, the sensors 410, 410' may obtain information about a tubular string located at well center. For example, the sensors 410, 410' may obtain information about at least one of the stick-up height of the tubular string, distance of the tubular string to the positioning device 420-*p*, tubular string position relative to the tong in the tong cassette 420-*t*, and combinations thereof.

The information 442 may be analyzed to determine further information. For example, the information 442 is analyzed to determine a distance between the positioning device 420-*p* and the tong cassette 420-*t*. As another example, the orientation of tong cassette 420-*t* relative to the positioning device 420-*p* can be determined by comparing the distance multiple sensors on the positioning device 420-*p* and multiple targets on the tong cassette 420-*t*.

Efficient and/or optimal trajectories for movement of tong cassette 420-*t* may be calculated by a local controller 440 and/or remote controller 450 based on the information 442 from the sensor 410. For example, the efficient and/or optimal trajectories may minimize time, maximize speed, minimize distance traveled, minimize fuel consumption, minimize risk to personnel, minimize component wear, or any combination of such or similar parameters.

Figure 3:
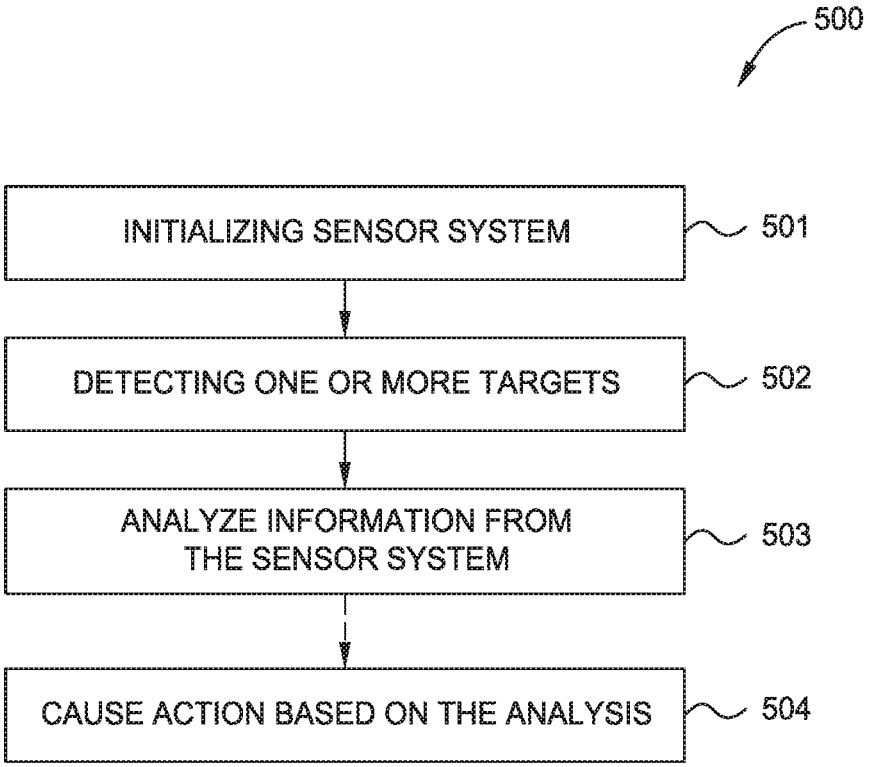
FIG. 3 illustrates an exemplary method utilizing a sensor system.

A method 500 utilizing sensor system 400 is illustrated in FIG. 3. The method begins at step 501, wherein a state of the sensor system 400 is initialized. For example, initializing a state of the sensor system 400 may include steps such as installing sensor 410 on positioning device 420-*p*, locating the positioning device 420-*p* on the rig floor 420-*r*, and/or locating the tong cassette 420-*t* on the rig floor 420-*r* at a predetermined location. In some embodiments, initializing a state of the sensor system 400 may involve an iterative process.

The method 500 continues at step 502, wherein the one or more targets 442-*t* are detected by the one or more sensors 410. For example, sensor 410 detects a distance between the target 442-*t* and the sensor 410.

The method 500 continues at step 503, wherein information from the one or more sensors 410 is analyzed. For example, relative distance of targets 442-*t* from the sensors 410 may be utilized to determine the distance between the positioning device 420-*p* and the tong cassette 420-*t*. Similarly, relative positioning and comparing distances of targets 442-*t* from the sensors 410 may be utilized to determine the orientation angle between the positioning device 420-*p* and the tong cassette 420-*t*. In some embodiments, local controller 440 may perform at least a portion of the analysis of the information. In some embodiments, remote controller 450 may perform a portion of the analysis of the information. Additional information may be utilized in the analysis. For example, additional information may include the arm length of the positioning device 420-*p*.

In some embodiments, the method 500 continues at step 504, wherein action is caused based on the analysis. For example, remote controller 450 and/or local controller 440 may send commands to actuators on positioning device 420-*p* based on the analysis of information in step 503. The positioning device 420-*p* may extend its arms a particular distance and angle based on the analysis of information in step 503, as illustrated in FIG. 2E. The method 500 may iterate as the positioning device 420-*p* connects to the tong cassette 420-*t*. For example, with the arms extended, the one or more sensors 410 may monitor the distance to the targets 442-*t* of the tong cassette 420-*t*. The targets 442-*t* may be detected and information from the sensors 410 may be analyzed. Based on the analysis, remote controller 450 and/or local controller 440 may generate command signals to lock the tong cassette 420-*t* in the arms of positioning device 420-*p*. It should be appreciated that causing action in step 504 may involve multiple iterations of method 500.

Figure 4:
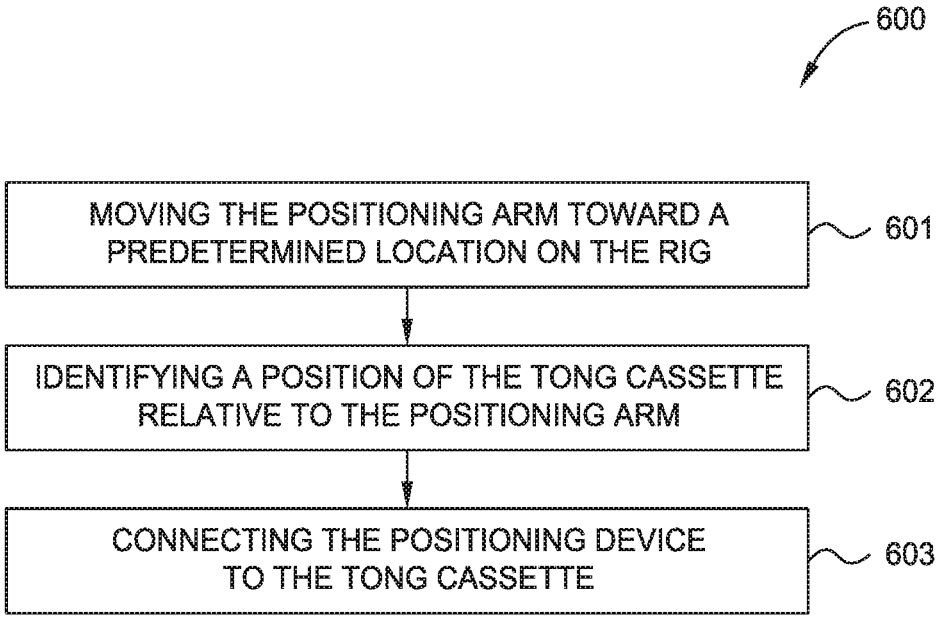
FIG. 4 illustrates another exemplary method utilizing a sensor system.

A method 600 utilizing sensor system 400 is illustrated in FIG. 4. The method begins at step 601, wherein the positioning arm is moved towards a predetermined location on the rig. For example, the tong cassette 420*t* may be placed on the rig floor 420-*r* at a predetermined location. An operator may select the predetermined location in a remote controller 150 of the positioning device 420-*p*. The remote controller 450 may send commands to the positioning device 420-*p* based on the operator's selection. The commands may instruct positioning device 420-*p* to begin extending arms 420-*a* holding a connector frame 420-*f* towards the predetermined location.

The method 600 continues at step 602, wherein a position of the tong cassette is identified relative to the positioning arm. For example, as the connector frame 420-*f* approaches the predetermined location, the sensor system 400 may operate to detect a positional relationship between the connector frame 420-*f* and the tong cassette 420-*t*. For example, the sensor system 400 may detect a proximity of the connector frame 420-*f* to the tong cassette 420-*t*. The sensor system may also detect an orientation of the connector frame 420-*f* to the tong cassette 420-*t*. During step 602, the sensor system 400 may relay information about the positional relationship to the control system for analysis. The control system in conjunction with the sensor system 400 may send commands to move the positioning device 420-*p* and connector frame 420-*f* thereon into a position where the tong cassette 420-*t* can be mechanically and operationally connected to the connector frame 420-*f*.

The method 600 continues at step 603, wherein the positioning device 420-*p* is connected to the tong cassette 420-*t*. The connector frame 420-*f* of the positioning device 420-*p* may be lowered by actuators on the positioning device 420-*p*. Based on the analysis in step 602, the connector frame may be moved into a position where the tong cassette 420-*t* can be mechanically and operationally connected to the connector frame. A crossbar of the connector frame moves below cassette hooks of the tong cassette. Thereafter, the crossbar is raised up to engage hooks on the tong cassette 420-*t*. The crossbar of the connector frame 420-*f* may support a weight of the tong cassette 420-*t*. A locking pin of the positioning device may be connected to the tong cassette 420-*t* to lock the tong cassette 420-*t* in place. The connected positioning device 420-*p* and tong cassette 420-*t* may be moved (e.g., retracted) to a neutral position on the rig floor and await instructions from the control system to perform an operation on the rig.

Figure 5:
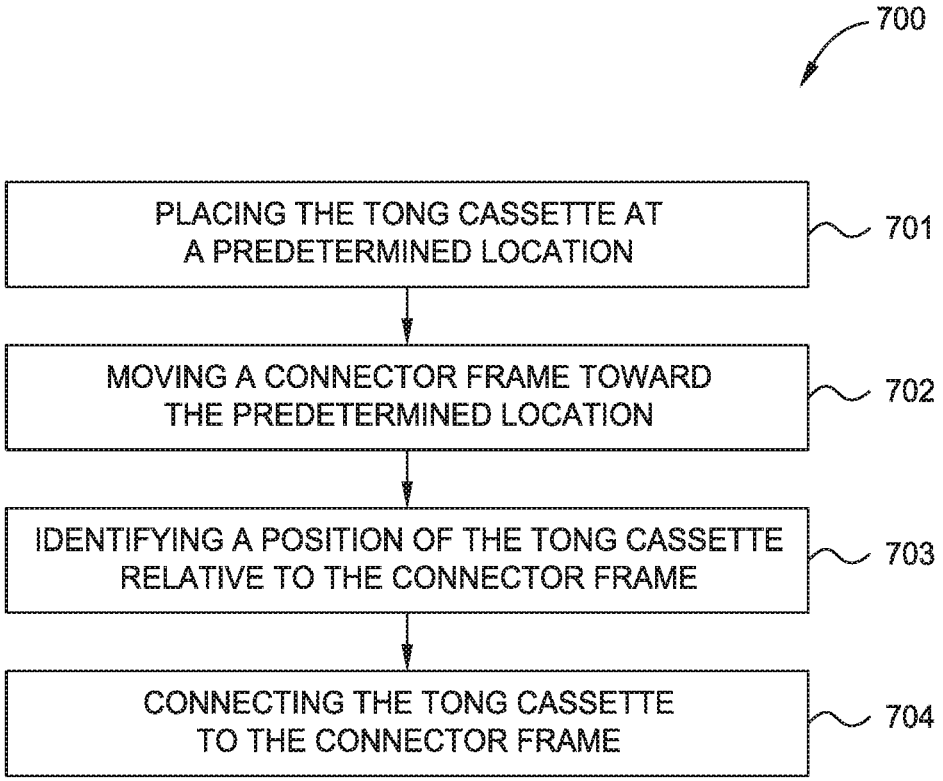
FIG. 5 illustrates another exemplary method utilizing a sensor system.

A method 700 utilizing sensor system 400 is illustrated in FIG. 5. The method begins at step 701, wherein the tong cassette 420-*t* is placed on the rig floor 420-*r* at a predetermined location. The predetermined location may be stored in the memory of a control system, such as remote controller 150, 450 and/or local controller 140.

The method 700 continues at step 702, wherein the connector frame 420-*f* of the positioning device 420-*p* is moved toward the predetermined location. An operator may select the predetermined location from a remote controller 150 of the positioning device 420-*p*. The remote controller 150 may send commands to the positioning device 420-*p* based on the operator's selection. The commands may instruct positioning device 420-*p* to begin extending arms 420-*a* holding a connector frame 420-*f* towards the predetermined location.

The method 700 continues at step 703, wherein a position of the tong cassette is identified relative to the connector frame of the positioning device. For example, as the connector frame approaches the predetermined location, the sensor system 400 may operate to detect a positional relationship between the connector frame and the tong cassette 420-*t*. For example, the sensor system 400 may detect a proximity of the connector frame to the tong cassette 420-*t*. The sensor system may also detect an orientation of the connector frame to the tong cassette 420-*t*. During step 703, the sensor system 400 may relay information about the positional relationship to the control system for analysis. The control system in conjunction with the sensor system 400 may send commands to move the positioning device 420-*p* and connector frame thereon into a position where the tong cassette 420-*t* can be mechanically and operationally connected to the connector frame.

The method 700 continues at step 704, wherein the tong cassette 420-*t* is connected to the connector frame of the positioning device 420-*p*. The connector frame of the positioning device 420-*p* may be lowered by actuators on the positioning device 420-*p*. Based on the analysis in step 703, the connector frame may be moved into a position where the tong cassette 420-*t* can be mechanically and operationally connected to the connector frame. A crossbar of the connector frame may be moved below cassette hooks of the tong cassette. Thereafter, the crossbar may be raised up and engage hooks on the tong cassette 420-*t*. The crossbar of the connector frame may support a weight of the tong cassette 420-*t*. A locking pin of the positioning device may be connected to the tong cassette 420-*t* to lock the tong cassette 420-*t* in place. The connected positioning device 420-*p* and tong cassette 420-*t* may be moved (e.g., retracted) to a neutral position on the rig floor and await instructions from the control system to perform an operation on the rig.

In one example, the positioning device 420-*p* moves the tong cassette 420-*t* from the neutral position on the rig floor toward a tubular string located at the well center. A position of the tubular string is identified relative to the positioning device. For example, the sensor system 400 may operate to detect a positional relationship between the tubular string and the positioning device and/or the tong cassette 420-*t*. The sensor system 400 may also detect a stick-up height of the tubular string. The sensor system 400 may relay information about the positional relationship to the control system for analysis. The control system in conjunction with the sensor system 400 may send commands to move the positioning device 420-*p* and the tong cassette 420-*t* into a position where the tong of the tong cassette 420-*t* can engage the tubular string.

In one or more of the embodiments disclosed herein, a method for connecting a tong cassette and a positioning device includes moving a positioning arm of the positioning device toward a predetermined position on the rig; identifying a position of the tong cassette relative to the positioning arm; and connecting the positioning arm to the tong cassette.

In one or more of the embodiments disclosed herein, the positioning device includes a first sensor configured to measure a distance between the positioning arm and the tong cassette and a second sensor configured to measure a stick-up height of a tubular string.

In one or more of the embodiments disclosed herein, the method further includes actuating a lock pin of the positioning arm.

In one or more of the embodiments disclosed herein, wherein moving the positioning arm further includes extending arms of the positioning device towards the tong cassette.

In one or more of the embodiments disclosed herein, the method further including raising the tong cassette from the rig floor.

In one or more of the embodiments disclosed herein, the method further including retracting the positioning arm and the tong cassette to a neutral position.

In one or more of the embodiments disclosed herein, the method further including moving a connector frame of the positioning arm relative to the tong cassette.

In one or more of the embodiments disclosed herein, the method further including moving a cross bar of the connector frame below a cassette hook of the tong cassette.

In one or more of the embodiments disclosed herein, the method further including raising the cross bar to engage the cassette hooks.

In one or more of the embodiments disclosed herein, a system includes a tong cassette; and a positioning device having: a first sensor configured to measure a distance between the tong cassette and the positioning device; and a second sensor configured to measure a stick-up height of a tubular string.

In one or more of the embodiments disclosed herein, the positioning device further having: a connector frame; and a pair of arms coupled to the connector frame.

In one or more of the embodiments disclosed herein, wherein the connector frame includes a cross bar configured to engage cassette hooks of the tong cassette.

In one or more of the embodiments disclosed herein, wherein the connector frame includes a lock pin configured to restrain movement of the tong cassette relative to the positioning device.

In one or more of the embodiments disclosed herein, wherein the first sensor is disposed on the connector frame.

In one or more of the embodiments disclosed herein, wherein the first sensor is a proximity sensor.

In one or more of the embodiments disclosed herein, wherein the first sensor is a length transducer.

In one or more of the embodiments disclosed herein, a method for connecting a tong cassette and a connector frame of a positioning device, includes: placing the tong cassette at a predetermined position on the rig; moving a connector frame of the positioning device toward the predetermined position; identifying a position of the tong cassette relative to the connector frame; and connecting the tong cassette to the connector frame.

In one or more of the embodiments disclosed herein, the method further includes moving the connector frame longitudinally relative to the tong cassette.

In one or more of the embodiments disclosed herein, the method further includes locking the tong cassette to the connector frame.

In one or more of the embodiments disclosed herein, the method further includes retracting the connector frame and the tong cassette to a neutral position.

While the foregoing is directed to embodiments of the present disclosure, other and further embodiments of the disclosure may be devised without departing from the basic scope thereof, and the scope thereof is determined by the claims that follow.

The invention claimed is:

1. A method for connecting a tong cassette and a positioning device on a rig, comprising:

moving a positioning arm of the positioning device toward a predetermined position on the rig, wherein the tong cassette is located at the predetermined position;

using a first sensor to identify a position of the tong cassette relative to the positioning arm, the first sensor configured to detect a plurality of sensor targets located on the tong cassette;

determining an orientation angle and a distance between the positioning arm and the tong cassette;

moving the positioning arm to a position for connection with the tong cassette based on the distance and the orientation angle; and then connecting the positioning arm to the tong cassette.

2. The method of claim 1, the positioning device having:

a second sensor configured to measure a stick-up height of a tubular string.

3. The method of claim 1, further comprising actuating a lock pin of the positioning arm.

4. The method of claim 1, wherein moving the positioning arm includes extending arms of the positioning device towards the tong cassette.

5. The method of claim 1, further comprising raising the tong cassette from the rig floor.

6. The method of claim 1, further comprising retracting the positioning arm and the tong cassette to a neutral position.

7. The method of claim 1, wherein connecting the positioning arm comprises connecting a connector frame of the positioning arm relative to the tong cassette.

8. The method of claim 7, wherein connecting the positioning arm further comprising moving a cross bar of the connector frame below a cassette hook of the tong cassette.

9. The method of claim 8, further comprising raising the cross bar to engage the cassette hooks.

10. The method of claim 1, wherein determining the orientation angle comprises using the first sensor to detect a relative distance of the first sensor from the plurality of sensor targets on the tong cassette as the positioning arm moves toward the tong cassette for connection therewith.

11. A system, comprising:

a tong cassette having a plurality of sensor targets disposed thereon;

a positioning device having:

a first proximity sensor configured to detect the plurality of sensor targets and to measure a distance between the tong cassette and the positioning device; and a second sensor configured to measure a stick-up height of a tubular string; and a controller configured to use distance data from the first proximity sensor to determine an orientation angle, the controller configured to move the positioning device to a position for connection with the tong cassette based on the measured distance and the orientation angle.

12. The system of claim 11, the positioning device further having:

a connector frame; and a pair of arms coupled to the connector frame.

13. The system of claim 12, wherein the connector frame includes a cross bar configured to engage cassette hooks of the tong cassette.

14. The system of claim 12, wherein the connector frame includes a lock pin configured to restrain movement of the tong cassette relative to the positioning device.

15. The system of claim 12, wherein the first sensor is disposed on the connector frame.

16. A method for connecting a tong cassette and a connector frame of a positioning device on a rig, comprising:

placing the tong cassette at a predetermined position on the rig;

moving the connector frame of the positioning device toward the predetermined position;

using a first sensor to identify a position of the tong cassette relative to the connector frame, the first sensor configured to detect a plurality of sensor targets located on the tong cassette;

determining a distance and an orientation angle between the connector frame and the tong cassette by comparing distances of the plurality of sensor targets to the first sensor;

moving the positioning arm to a position for connection with the tong cassette based on the distance and the orientation angle; and then connecting the tong cassette to the connector frame.

17. The method of claim 16, further comprising moving the connector frame longitudinally relative to the tong cassette.

18. The method of claim 16, further comprising locking the tong cassette to the connector frame.

19. The method of claim 16, further comprising retracting the connector frame and the tong cassette to a neutral position.

20. The method of claim 16, wherein connecting the tong cassette to the connector frame comprises engaging a cross bar of the connector frame to cassette hooks of the tong cassette.

21. The method of claim 20, wherein engaging the cross bar to the cassette hooks comprises moving the cross bar below the cassette hooks, and then raising the cross bar to engage the cassette hooks.

22. The method of claim 1, wherein the predetermined location is stored in a controller for controlling movement of the positioning device prior to placing the tong cassette in the predetermined location.

23. The method of claim 22, wherein using a first sensor to identify a position of the tong cassette relative to the positioning arm occurs while the positioning arm is moving toward the predetermined position.

* * * * *